US005775428A

United States Patent [19]

Davis et al.

[11] Patent Number: 5,775,428

[45] Date of Patent: Jul. 7, 1998

[54] WHIPSTOCK-SETTING APPARATUS

[75] Inventors: Jerry Davis, Spring; Gerald Lynde, Houston, both of Tex.

[73] Assignee: Baker Hughes Incorporated, Houston, Tex.

[21] Appl. No.: 752,839

[22] Filed: Nov. 20, 1996

[51] Int. Cl.[6] ..... E21B 7/08; E21B 23/04

[52] U.S. Cl. ..... 166/381; 166/117.6

[58] Field of Search ..... 166/117.5, 117.6, 166/297, 298, 381

[56] References Cited

U.S. PATENT DOCUMENTS

| | | | |
|---|---|---|---|
| 3,397,746 | 8/1968 | Link . | |
| 4,397,355 | 8/1983 | McLamore . | |
| 4,765,404 | 8/1988 | Bailey et al. | 166/117.6 |
| 5,035,292 | 7/1991 | Bailey et al. . | |
| 5,109,924 | 5/1992 | Jürgons et al. | 166/117.5 |
| 5,154,231 | 10/1992 | Bailey et al. . | |
| 5,277,251 | 1/1994 | Blount et al. | 166/117.5 |
| 5,287,921 | 2/1994 | Blount et al. | 166/117.6 |
| 5,425,419 | 6/1995 | Sieber | 166/117.6 X |
| 5,427,179 | 6/1995 | Bailey et al. . | |
| 5,431,220 | 7/1995 | Lennon et al. . | |
| 5,443,129 | 8/1995 | Bailey et al. . | |
| 5,499,682 | 3/1996 | Sieber | 166/382 |

*Primary Examiner*—Frank Tsay
*Attorney, Agent, or Firm*—Rosenblatt & Redano P.C.

[57] ABSTRACT

The invention allows running, in one trip, a packer-setting tool, a whip-stock, and a window-milling system into the wellbore. Between the whipstock and the packer is a packer-setting tool. A flow passage extends through a portion of the whipstock into the setting tool. One or more seals are located between the whipstock and the setting tool if below the packer to be set there are already perforations which could result in fluid losses if they are pressurized. If there are uphole perforations which will cause fluid losses, one or more seals are disposed above the milling string. When both lower and upper seals are used below the whipstock and above the milling string, the zone between the seals is isolated in the wellbore, and pressure goes through the tubing, exits the tubing between the seals, and reenters into the lower end of the whipstock where it communicates with the setting tool for hydraulically setting the packer to support the whipstock. If there are no locations where fluid losses can occur uphole, pressure can be applied through the tubing or the annulus above the whipstock and the pressure communicates through the passage in the whipstock into the setting tool below the whipstock so that the packer can be set for support. When using seals above and below, a one-trip system for squeezing perforations below the packer and milling a window in the casing is enabled.

14 Claims, 3 Drawing Sheets

WHIPSTOCK-SETTING APPARATUS

FIELD OF THE INVENTION

The field of this invention relates to a one-trip apparatus and method for supporting a whipstock with a packer in a variety of downhole circumstances and squeezing cement into perforations below the packer.

BACKGROUND OF THE INVENTION

Whipstocks are used to initiate lateral openings in casings. The casing is milled using one or more mills which are directed toward the casing by the sloping whipstock face. One-trip milling systems have been developed, as illustrated in U.S. Pat. 5,109,924 issued to Jurgens. Whipstocks are generally set with packers as the anchor. The packer requires a setting tool to create relative movement in order to set the packer. In prior designs, a jumper line was usually provided from the tubing string around the whipstock into the setting tool. These jumper lines, regardless of how they were routed, presented a hazard that they would then kink or break while the assembly was being run into the wellbore. Additionally, these jumper lines were of a relatively small diameter and had short radius bends. While they were serviceable to actuate a packer setting tool below the whipstock with limitations described above, they could not be used to effectively convey cement. typical of such installations is the Pack Stock Casing Sidetracking System offered by A–Z International Tool Company of Houston, Tex. This installation has a line from a mill around a whipstock which is used to set the packer. The mill is picked up to release from the whipstock and the tube, and the onset of milling grinds up the tube. The grinding up of a portion of the tube can cause problems with the operation of the mill as it tries to start a window. This system also will not accommodate pumping cement into perforations below the packer which supports the whipstock.

One of the objectives of the present invention is to eliminate the jumper line but at the same time provide a technique where pressure can be applied to a setting tool for the packer located below the whipstock. Accordingly, one or more seals are employed, depending on downhole conditions, to allow pressurization of the setting tool to create the relative movement necessary to set the packer to support the whipstock. Another objective is to allow pumping cement into perforations below the packer in conjunction with a one-trip system to position a whipstock and mill a window.

Squeeze tools which are retrievable have been used in isolation to pump cement under pressure into a perforated zone by setting up a tool such as a Baker Oil tools Retrievable Cementer, Model C-1, Product No. 410-01, or a Halliburton RTTS cementing tool above the perforations. These tools did not contemplate a one-trip system involving a whipstock.

One-trip milling systems previously used, i.e., Jurgens U.S. Pat. No. 5,109,924, used a small jumper tube around the whipstock and did not contemplate squeezing cement below the packer.

Downhole straddle tools using inflatable technology have been used in the past for such functions as a drill stem test. One such tool is sold by Baker Oil Tools and is called Inflatable DST, Product No. 302-40.

Pressure-actuated isolation tools using opposed cup-type seals, such as Baker Oil Tools A-A Combination Tool, Product No. 304-02, or the RS PIP tool from Baker Oil Tools, have been used to isolate a segment of a well for a variety of completion and production operations.

SUMMARY OF THE INVENTION

The invention allows running, in one trip, a packer-setting tool, a whip-stock, and a window-milling system into the wellbore. Between the whipstock and the packer is a packer-setting tool. A flow passage extends through a portion of the whipstock into the setting tool. One or more seals are located between the whipstock and the setting tool if below the packer to be set there are already perforations which could result in fluid losses if they are pressurized. If there are uphole perforations which will cause fluid losses, one or more seals are disposed above the milling string. When both lower and upper seals are used below the whipstock and above the milling string, the zone between the seals is isolated in the wellbore, and pressure goes through the tubing, exits the tubing between the seals, and reenters into the lower end of the whipstock where it communicates with the setting tool for hydraulically setting the packer to support the whipstock. If there are no locations where fluid losses can occur uphole, pressure can be applied through the tubing or the annulus above the whipstock and the pressure communicates through the passage in the whipstock into the setting tool below the whipstock so that the packer can be set for support. When using seals above and below, a one-trip system for squeezing perforations below the packer and milling a window in the casing is enabled.

DETAILED DESCRIPTION OF THE DRAWINGS

DETAILED DESCRIPTION OF THE PREFERRED EMBODIMENT

Figure 1:
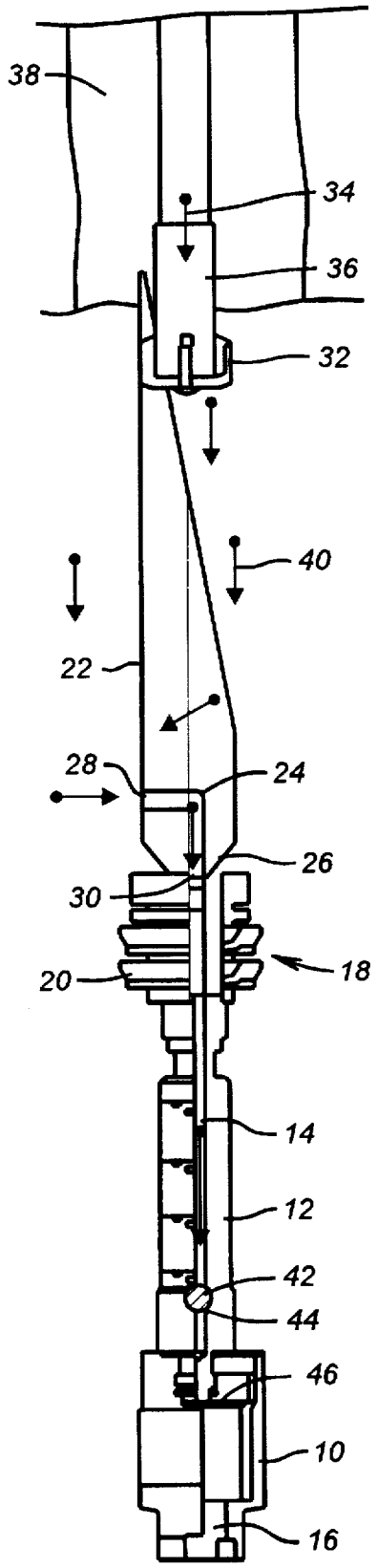
FIG. 1 is a sectional elevational view showing the use of a single set of swab cups for isolation of zones of potential fluid loss below the supporting packer.
Figure 2:
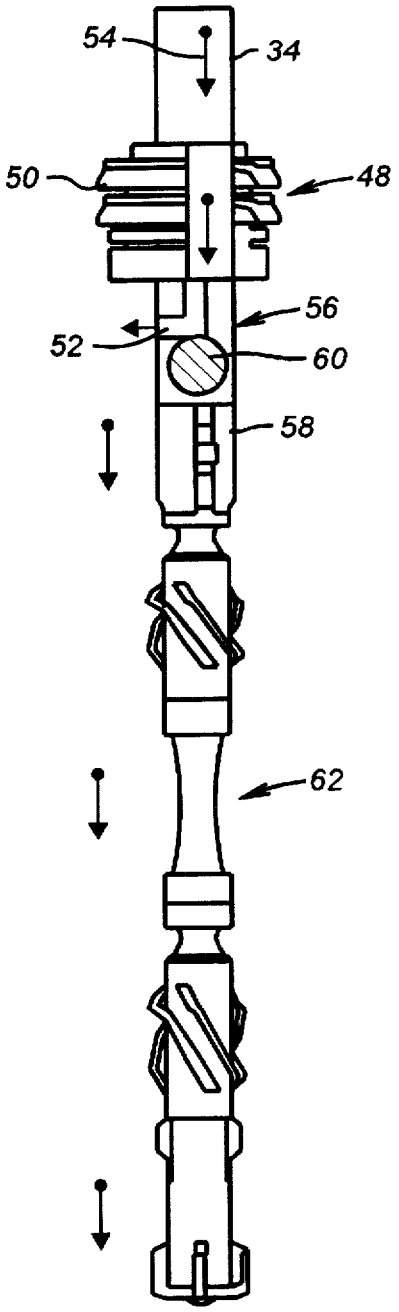
FIG. 2 is a sectional elevational view of an assembly that can be used in conjunction with the whipstock and components below it illustrated in FIG. 1 when zones of potential fluid loss exist uphole of the whipstock.

FIG. 1 illustrates schematically a permanent or retrievable packer 10. Above packer 10 is setting tool 12. Setting tool 12 has a passage 14 extending therethrough. The packer 10 has a passage 16 extending therethrough in flow communication with passage 14 in the setting tool 12. Above the setting tool 12 is the lower seal assembly 18 which contains one or more preferably swab-type cup seals 20. The seals 20 are looking up and are designed to stop pressure from uphole from getting past them. Above the seal assembly 18 is a whipstock 22. Whipstock 22 has a passage 24 which in the preferred embodiment is adjacent the lower end 26 of the whipstock 22. Passage 24 makes a gradual bend from its inlet 28 to its outlet 30. Shown schematically above the whipstock 22 is a one-trip milling system akin to that disclosed in Jurgens U.S. Pat. No. 5,109,924. Only the lowermost mill 32 is illustrated and it is attached to the whipstock 22 in a known manner. In situations where there are no perforations uphole of the whipstock 22 so that pressurization of the wellbore will not result in fluid losses or formation damage, the assembly in FIG. 1 can be employed. Arrow 34 represents schematically flow through the tubing 36 which exits from the lowermost mill 32 and eventually flows through inlet 28 to outlet 30 and into the setting tool 12 for ultimate setting of the packer 10. Alternatively, instead of pumping through the tubing 36, pumping from the surface can be through the annulus 38, with the flow down to inlet 28 going around the whipstock 22, as indicated by arrows 40. Those skilled in the art can see that the swab-type cup seals 20 allow pressure build-up to occur adjacent the inlet 28 so that the setting tool 12 can be pressurized through passage 14 for setting of the packer 10.

Referring to the schematic illustration of the known setting tool 12, it has a ball 42 which can be forced against a seat 44 which spans the passage 14. The seat 44 is generally in a sliding sleeve which creates the requisite relative movement for setting of the packer 10. An inflatable can also be used without departing from the spirit of the invention. In the preferred embodiment, the setting tool 12 is attached to the whipstock 22 and may be subsequently removed from the packer 10. Additionally, the ball 42 can be blown past seat 44 and caught in a ball catcher 46. Alternatively, the ball 42 can be blown through the passage 16 in the packer 10 so that it falls to the bottom of the hole. In this manner, production can also be obtained through the packer 10, even after the lateral is milled using the whipstock 22.

In the event there is a potential for fluid loss uphole, an upper seal assembly 48 is used which contains a sealing device 50 that preferably is inflatable. The inflatable 50 keeps any pressure created at outlet 52 of the tubing 34 from going uphole beyond it. When the potential for fluid losses exists uphole and downhole, the combination of the lower seal assembly 18 and upper seal assembly 48 are used. In that situation, the flow goes from the tubing 34, as indicated by arrow 54, out through the outlet 52 and around the whipstock 22, as shown in Figure by arrows 40. Finally, the flow is through inlet 28, into the setting tool 12 to set the packer 10 in the manner described above.

Below the upper seal assembly 48 is a ball sub 56, with a ball catcher sub 58 below. Adding pressure through the tubing 34 will shift ball 60 to open outlet 52. Ultimately, when ball 60 is blown into the ball catcher 58, outlet 52 is closed to permit pressurized flow to go through the mill assembly 62. The ball sub 56 is a known component, essentially making use of the ball 60 to shift a sliding sleeve which allows flow through outlet 52, while when ball 60 is blown through the sleeve, the sleeve shifts to close outlet 52.

If there are no potential sources of fluid loss downhole from the packer 10, the lower seal assembly 18 is optional. If there are no potential sources of fluid loss uphole from the mill assembly 62, the use of upper seal assembly 48 is also optional. By using both the lower seal assembly 18 and upper seal assembly 48, both contingencies are addressed in that applied pressure from the surface will only be seen in the wellbore in the zone defined between the inflatable 50 and lower seals 20. While swab-type cup seals are preferred for lower seal assembly 18, other types of seals can function as lower seals 20 without departing from the spirit of the invention. The use of an inflatable 50 allows it to be subsequently deflated to allow cuttings from the milling of a window operation to be circulated to the surface.

Once the packer 10 is set, the one-trip milling, as described in Jurgens U.S. Pat. No. 5,109,924, using the mill assembly 62 can be undertaken.

Figure 3:
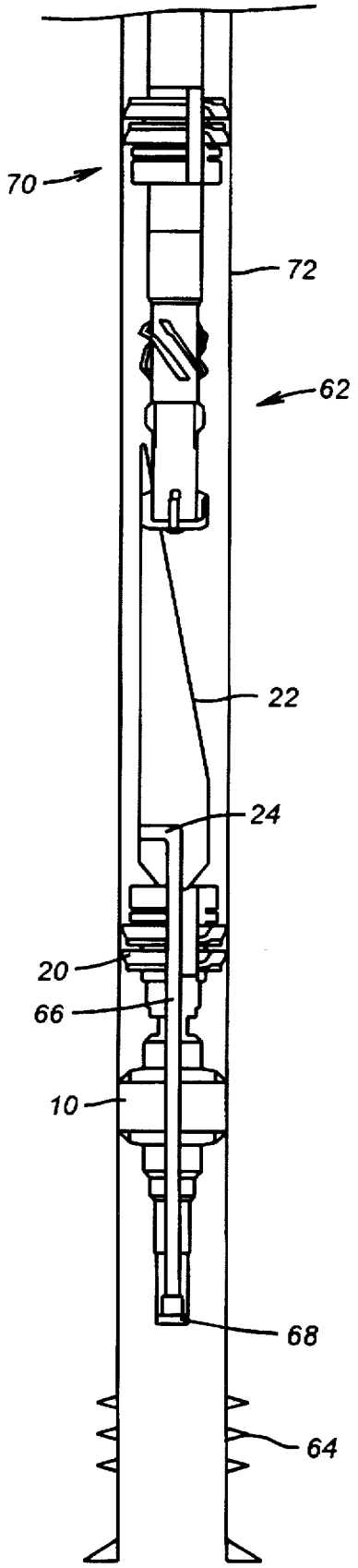
FIG. 3 is a schematic illustration of a one-step window-milling system having a squeeze feature for the perforations below.
Figure 4:
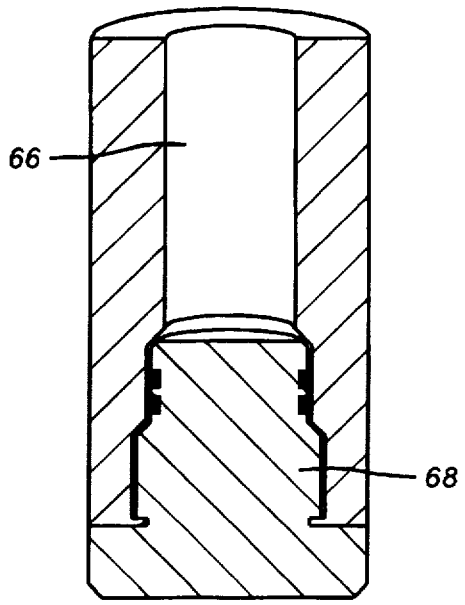
FIG. 4 is a detail of a bottom plug assembly which can be displaced after a packer is set.

Another application of the one-trip system is illustrated in FIGS. 3–6. The purpose of this application is to allow a one-trip window-milling system, in conjunction with features which permit squeezing cement into perforations 64 which are situated below where the whipstock 22 is positioned when supported by the packer 10. FIG. 3 illustrates schematically the packer 10. Packer 10 has a passage 66 extending therethrough which is in flow communication with passage 24 through the whipstock 22. The diameter of passage 66 and passage 24 is made as large as possible within the constraints of the particular application to facilitate the ultimate flow of cement to the perforations 64. At the bottom of passage 66 is a pressure plug 68, shown in more detail in FIG. 4. In essence, pressure plug 68 allows pressure build-up within the packer 10 so that it may be set as shown in FIG. 3, with the plug 68 in position. Thereafter, a further pressure increase above a predetermined value displaces the plug 68 from the lower end of passage 66 to permit the pumping of cement through passage 24, through passage 66 and down to the perforations 64.

The assembly is completed with the one-trip milling system 62 attached to the face of the whipstock 22 during run-in. Those skilled in the art will appreciate that jumper lines, such as used in the prior art, from the milling string to the packer below the whipstock or to the base of the whipstock, have been eliminated. Above the milling assembly 62 is an inflatable sealing tool 70 which can be selectively actuated to block off the casing 72 above the mill assembly 62. As previously described, the seals 20 are preferably cup-type seals and have an upward orientation to keep pressure from above from getting downhole.

In essence, this assembly, as shown in FIG. 3, can allow for the pumping of a fluid to set the packer 10 and the sealing tool 70 under pressure. With the sealing tool 70 and the packer 10 set, the seal elements 20 and the sealing tool 70, in effect, force any subsequently pumped cement around the whipstock 22, through passage 24, and into passage 66 where the cement is blown out when plug 68 is pumped out of the way by applied pressure. In this manner, the perforations 64 are squeezed, i.e., subjected to pressurized cement. When the squeeze operation on the perforations 64 is concluded, the packer 10 remains in a set position while various manipulation techniques are used from the surface to relax the sealing tool 70 to open up an annulus around the milling assembly 62. Once the milling starts using the one-trip milling system 62, fluid is circulated so that the cuttings from the casing 72 are circulated up to the surface and removed by known separation techniques.

Figure 5:
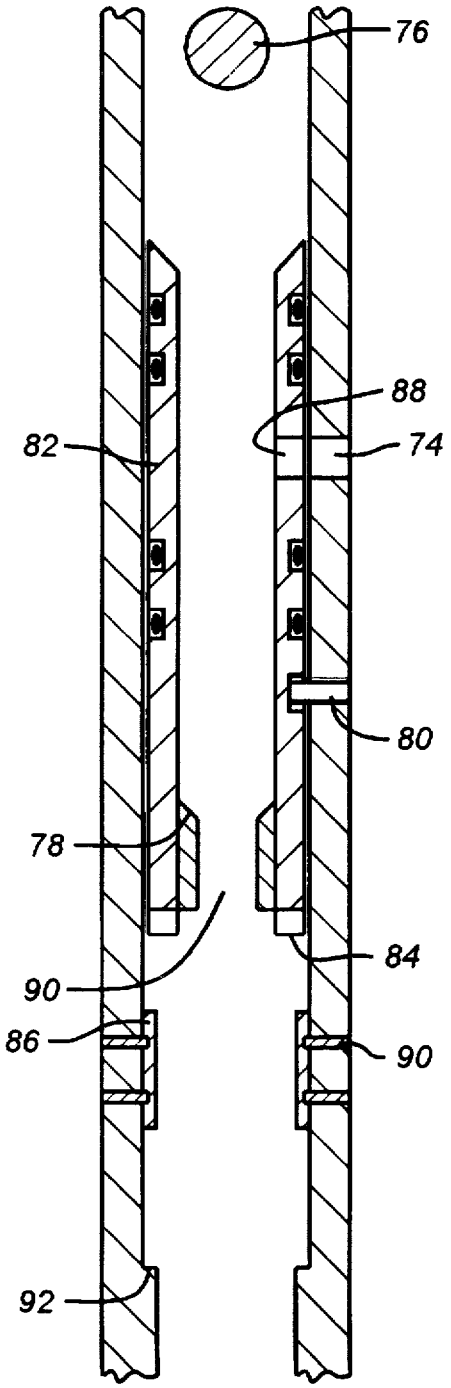
FIG. 5 is a sectional elevational view of a valve assembly for control of an inflatable barrier mounted above the one-trip milling system.
Figure 6:
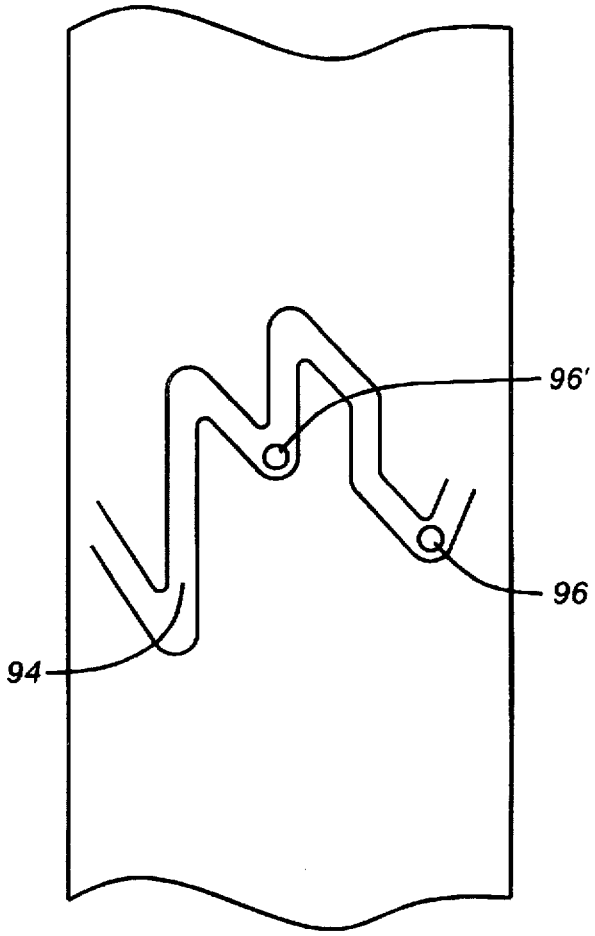
FIG. 6 is a detail of a J-slot design for control of a valve assembly for the inflatable barrier mounted above the one-trip milling system.

FIGS. 5 and 6 illustrate some techniques that are available to selectively set the sealing tool 70 for the squeeze operation and later release it for the milling operation of mill assembly 62.

Referring now to FIGS. 3 and 5, the operation of the plug 68 has already been described. At the beginning of the operation, fluid such as drilling mud can be pumped down the wellbore against the plug 68. A sufficient pressure is built up to set the packer 10 and, at the same time, set the sealing tool 70 which receives pressure through port 74. Ultimately, when sufficient pressure from the surface has been built up, the plug 68 is blown out and pressure is exerted directly on the perforations 64. A valve sub can be inserted above plug 68 to close off the recently sealed perforations 64. At that time, a ball 76 can be dropped into seat 78 to break shear pin 80, thus displacing sleeve 82 to a point where its lower end 84 hits the seat 86. In that position, passage 74 is sealingly isolated from passage 88 so that when the cement is subsequently pumped, it will not enter passage 74. The ball 76 could then be either blown through the restriction 78 or eroded to reopen the flowpath 90 for the pumping of the cement which will ultimately reach the perforations 64 due to the operation of seals 20, which will direct the cement into passages 24 and 66.

When the squeeze cementing is concluded, another ball can be dropped to land on seat 78 to allow the sleeve 82 to move further downwardly as shear pins 90, which hold up seat 86, are broken. The entire assembly then moves downwardly until everything bottoms on shoulder 92. Once the sleeve 82 is allowed to move that much further down, it again exposes passage 74 to allow the sealing tool 70 to deflate. When this occurs, circulation through the mill assembly 62 can start and milling of a window in the casing 72 can begin. The cuttings generated now can pass beyond the sealing tool 70 which has already been deflated.

FIG. 6 illustrates an alternative way to obtain the various movements with regard to the operation of the sealing tool 70. Instead of using shear pins and balls, a J-slot assembly 94 can be used to functionally position the sleeve 82 in the positions previously described by manipulation of the string from the surface, generally by picking up and setting down the requisite number of times to position a pin 96 into another position, such as 96'.

The significant steps of the method are to isolate a zone in the wellbore around the mill assembly 62 and the whipstock 22. By doing this, jumper lines around the whipstock 22 are eliminated and larger passages with gradual turns can be used to facilitate the ultimate pumping of cement down to the perforations 64. In a preferred embodiment, the cup-shaped seals 20 can be used below the whipstock 22 and an inflatable sealing tool 70 can be used above. The packer 10 can be an inflatable or settable with a setting tool that operates on relative movement. A flow passage is necessary through the sealing tool 70 when in its set position so that the pumped cement will be squeezed into the perforations 64. At the conclusion of the cementing operations, the sealing tool 70 needs to be deflated so that the cuttings that are generated from the milling of the window using mill assembly 62 can be circulated from the surface. Those skilled in the art can appreciate that the manipulation of the various components as to how they are set or how they retain their position during the various steps of the method can be accomplished in a variety of alternative equivalent means without departing from the spirit of the invention.

The foregoing disclosure and description of the invention are illustrative and explanatory thereof, and various changes in the size, shape and materials, as well as in the details of the illustrated construction, may be made without departing from the spirit of the invention.

We claim:

1. A one-trip window-milling method, comprising:

running in a single trip a whipstock support, at least one annular seal, a whipstock, and at least one mill;

setting said whipstock support by applying pressure outside said whipstock;

using said annular seal to direct said applied pressure into an opening in the whipstock for setting said support;

milling the window.

2. The method of claim 1, further comprising:

locating a first said annular seal between said whipstock and said support.

3. The method of claim 2, further comprising:

using at least one upwardly oriented cup seal as said first said annular seal.

4. The method of claim 1, further comprising:

using a first said seal above said mill and a second said seal below said whipstock, with said mill connected to said whipstock;

pressurizing outside said mill and said whipstock and between said seals to set said support.

5. The method of claim 4, further comprising:

providing access to below said support after actuating said support with pressure;

pumping a sealing material through said whipstock opening and into perforations below said support;

sealing off said perforations.

6. The method of claim 5, further comprising:

using a retractable seal as said first seal above said mill;

retracting said first seal prior to milling.

7. The method of claim 6, further comprising:

using a plug in said support to allow pressure build-up behind it to set said support and actuate said first seal;

blowing out said plug when a predetermined pressure is reached.

8. The method of claim 7, further comprising:

holding actuation pressure in said first seal after blowing out said plug;

isolating a bore in said first seal from said sealing material when said sealing material is pumped therethrough.

9. The method of claim 8, further comprising:

retracting said first seal by moving a sleeve therein from a first to a second position.

10. The method of claim 9, further comprising:

isolating said seal from said sealing material pumped therethrough by positioning said sleeve in said second position to cover an access passage on said first seal while holding said first seal in an actuated position.

11. The method of claim 10, further comprising:

providing a third position on said sleeve wherein said access passage is exposed for initial actuation of said first seal.

12. The method of claim 11, further comprising:

using a J-slot assembly to reposition said sleeve among said positions.

13. The method of claim 11, further comprising:

using at least one dropped ball combined with pressure to reposition said sleeve.

14. The method of claim 4, further comprising:

using a valve sub below said first seal;

directing flow into the annular space around said whipstock for setting said anchor through said valve sub when it is in a first position;

resetting said valve sub to direct flow through said mill for subsequent circulation through said mill to remove cuttings during milling.

* * * * *